United States Patent [19]

Mumford et al.

[11] 4,432,461

[45] Feb. 21, 1984

[54] TAMPER INDICATING PACKAGE

[75] Inventors: George V. Mumford; Ernest L. Li, both of Toledo, Ohio

[73] Assignee: Owens-Illinois, Inc., Toledo, Ohio

[21] Appl. No.: 366,796

[22] Filed: Apr. 9, 1982

[51] Int. Cl.[3] ..... B65D 41/34

[52] U.S. Cl. ..... 215/252

[58] Field of Search ..... 215/252

[56] References Cited

U.S. PATENT DOCUMENTS 4,196,818 4/1980 Brownbill ..... 215/252

4,346,811 8/1982 Hilaire ..... 215/252

*Primary Examiner*—Donald F. Norton

*Attorney, Agent, or Firm*—John R. Nelson; Myron E. Click

[57] ABSTRACT

A tamperproof package comprising a container having a neck with external threads formed thereon and a plastic closure comprising a top panel and an integral depending annular skirt having integral internal threads formed thereon complementary to the threads on the neck of the container. The container has an annular locking bead positioned axially below the threads. The skirt has a pilfer ring at the lower end thereof connected to the upper portion of the skirt by a plurality of circumferentially spaced integral bridge portions that are located below the threads when the closure is on the container. The ring has a radially inwardly extending annular rib engaging beneath the locking bead of the container when the closure is on the container. One of the bridge portions has a greater cross section than the remainder of the bridge portions such that when the closure is applied to the container, the rib on the pilfer ring snaps over and engages below the locking bead on the container, and when the closure is rotated to remove the closure from the container, the bridge portions are broken except for the bridge portion having the greater cross section such that the pilfer ring remains connected to the closure.

12 Claims, 10 Drawing Figures

TAMPER INDICATING PACKAGE

This invention relates to packages and particularly to pilferproof packages.

BACKGROUND AND SUMMARY OF THE INVENTION

In the packaging of various commodities, it has become desirable to provide some indication as to whether the contents have been tampered with. In such packages, one common expedient has been to use a ring that is connected to the closure of the container and is broken or severed when attempts are made to remove the closure. In one type of such package, that is shown for example in U.S. Pat. Nos. 3,329,290 and 3,784,041, the closure includes an integral pilfer ring that snaps over an annular bead on the container and is fractured or severed from the closure when the closure is removed. In another type of package such as shown in U.S. Pat. Nos. 3,673,761, 4,206,852 and 4,033,472, the closure includes an integral ring which is deformed by heat over an annular bead when the closure is applied to the container, which ring is thereafter fractured or broken from the remainder of the closure when the closure is removed. In U.S. Pat. No. 4,033,472, the closure includes a portion that retains the pilfer ring in position.

Among the objectives of the present invention are to provide a package which has a pilfer ring that will function to indicate that the closure has been removed or tampered with, which does not require any special step in the application thereof to the container, which can be readily manufactured and which effectively provides an indication of tampering or removal of the closure while keeping the retaining ring attached to the closure.

In accordance with the invention, the tamperproof package comprises a container having a neck with external threads formed thereon and a plastic closure comprising a top panel and an integral depending annular skirt, the skirt having integral internal threads formed thereon complementary to the threads on the neck of the container. The container has an annular locking bead positioned axially below the threads. The skirt has a pilfer ring at the lower end thereof connected to the upper portion of the skirt by a plurality of circumferentially spaced integral bridge portions that are located below the threads when the closure is on the container. The ring has a radially inwardly extending annular rib engaging beneath the locking bead of the container when the closure is on the container. One of the bridge portions has a greater cross section than the remainder of the bridge portions such that when the closure is applied to the container, the rib on the pilfer ring snaps over and engages below the locking bead on the container, and when the closure is rotated to remove the closure from the container, the bridge portions are broken except for the bridge portion having the greater cross section such that the pilfer ring remains connected to the closure.

DESCRIPTION

Figure 1:
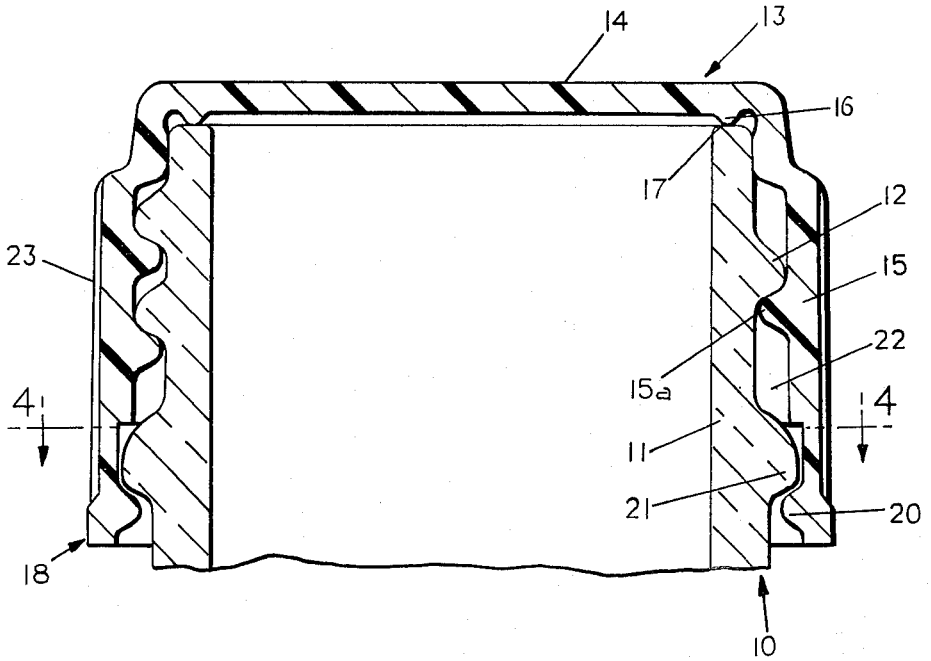
FIG. 1 is a fragmentary sectional view of a package embodying the invention.
Figure 4:
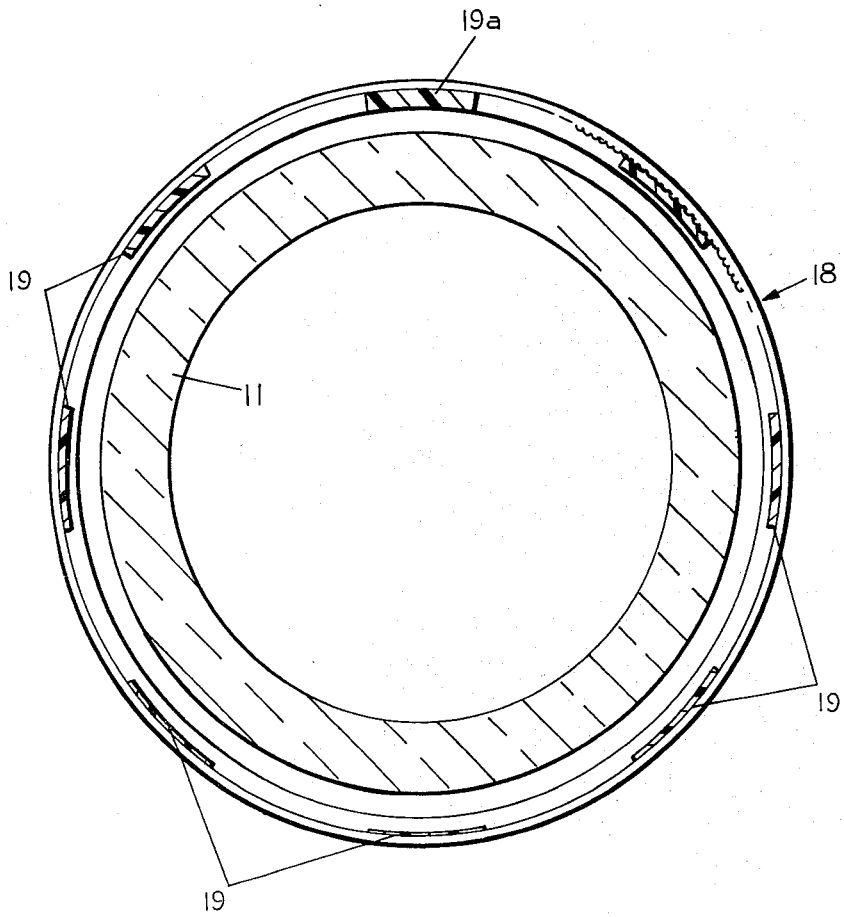
FIG. 4 is a fragmentary sectional view taken along the line 4—4 in FIG. 1.
Figure 5:
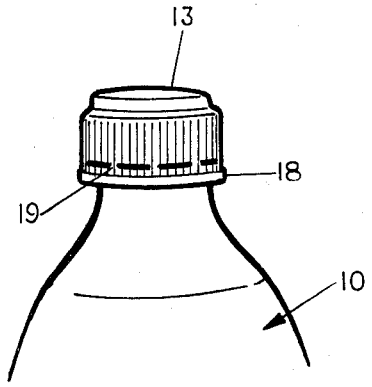
FIG. 5 is a fragmentary perspective view of a package with closure applied.
Figure 6:
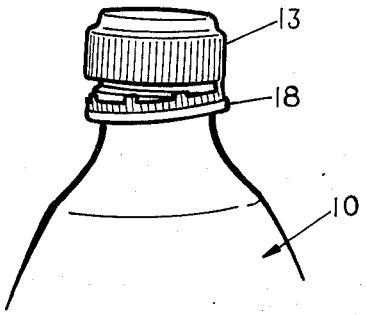
FIGS. 6, 7 and 8 are fragmentary perspective views showing the closure and container during various steps in the removal of the closure.
Figure 7:
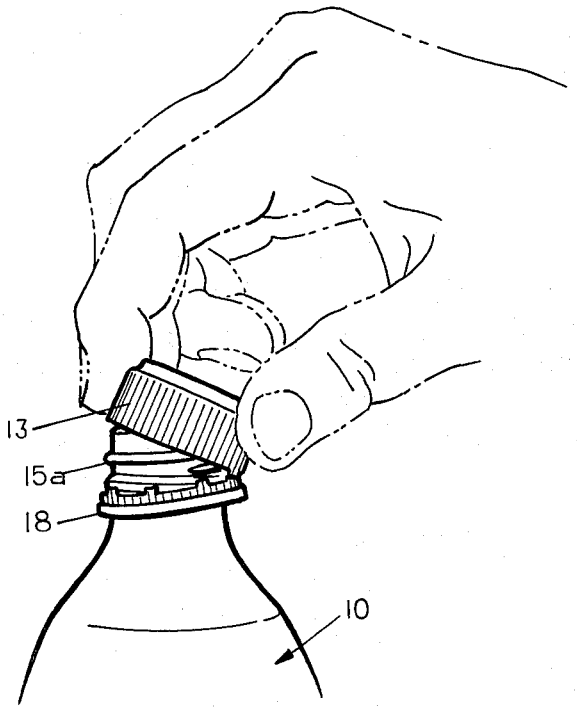
Figure 8:
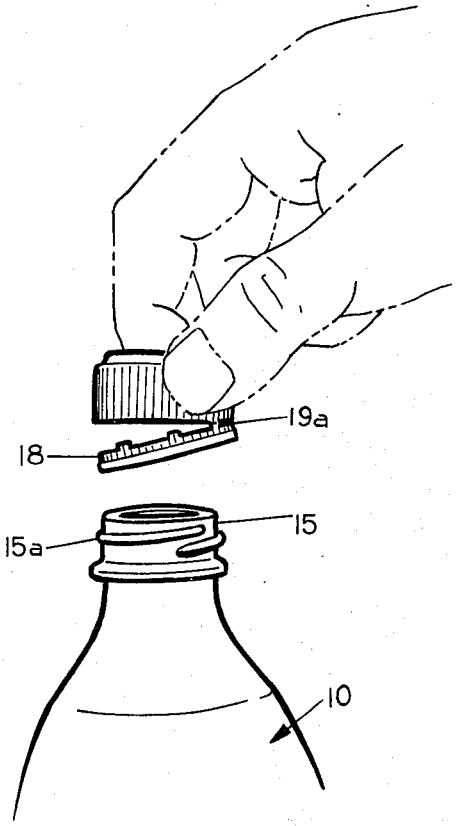

Referring to FIGS. 1 and 4, the package embodying the invention comprises a container 10 having a neck 11 with external threads 12 thereon and a plastic closure 13 including a top wall 14 and a peripheral skirt 15 having internal threads **15*a* for engaging threads 13. The top wall includes an annular rib 16 adapted to engage the upper end 17 of the container. The container may be made of glass or plastic. The closure 13** is preferably made of plastic such as high density polyethylene.

In accordance with the invention, the lower annular portion 18 of the skirt is connected to the remainder of the skirt by a plurality of integral bridge portions 19 to define a pilfer ring. One of the bridge portions **19*a* has a greater cross sectional area than the remainder of the bridge portions 19. The bridge portions preferably have a greater circumferential extent or length than radial thickness, with the radial thickness of the bridge portion 19*a* being greater than the radial thickness of the remaining bridge portions 19**.

The pilfer ring 18 further includes a radially inwardly extending annular rib 20 near its lower edge which extends beneath an annular locking bead 21 that is below the threads 12 on the container thereby defining a space 22 between the threads on the bead 21.

The closure may include serrations in the form of vertical ribs 23 to facilitate grasping the closure.

In order to apply the closure to the container, the closure 13 is threaded onto the container 10 and then by manually applying an axial force, the rib 20 on the closure 13 snaps below the locking bead 21 of the container, after which the closure 13 is tightened onto the container 10.

Figure 2:
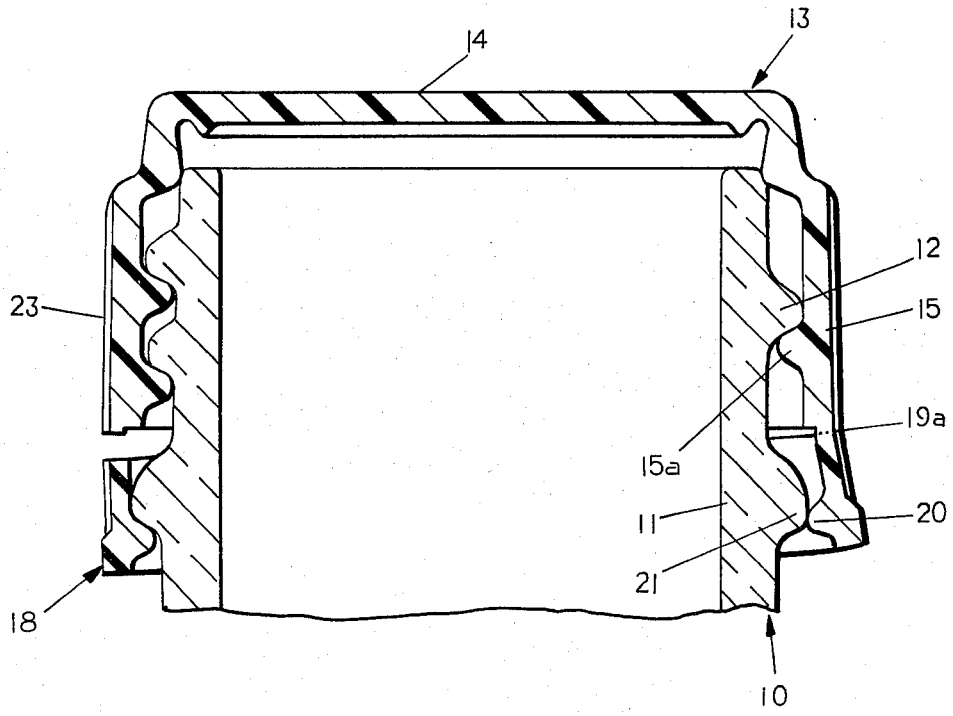
FIG. 2 is a fragmentary sectional view similar to FIG. 1 showing the package during removal of the closure.
Figure 3:
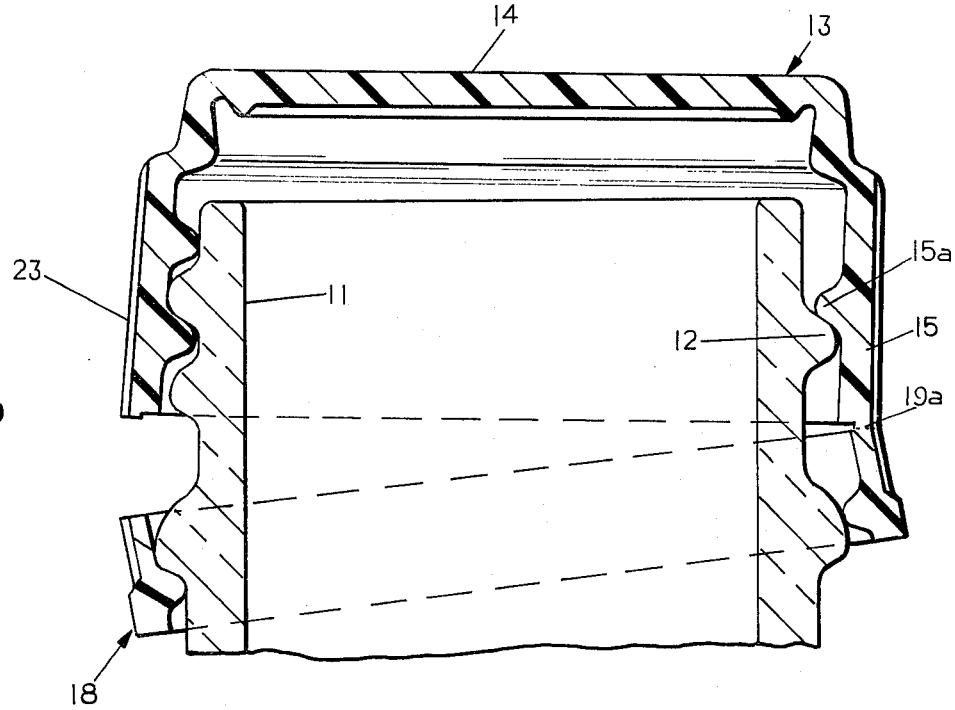
FIG. 3 is a fragmentary sectional view similar to FIGS. 1 and 2 showing the package during further step of removal of the closure.

Referring to FIG. 2, when the closure 13 is rotated to unthread the closure 13 from the container 10, the interaction of the threads 12 on the container 10 and the threads **15*a* on the closure 13 provide a force axially on each of the bridge portions. The dimensions of the bridge portions 19 are such that they are fractured or broken by this force except for the bridge portion 19*a* having the greater cross section. As shown in FIG. 3, continuous rotation of the closure 13 causes the pilfer ring 18 to snap over the annular bead 21 on the container 10. The thickness of the pilfer ring 18 radially is such that during this movement, the pilfer ring 18 assumes an oval configuration permitting it to snap over the annular bead 21**.

The continued unthreading of the closure 13 results in the closure being completely removed from the container with the pilfer ring 18 remaining connected to the closure by the thickened portion **19*a***.

Figure 9:
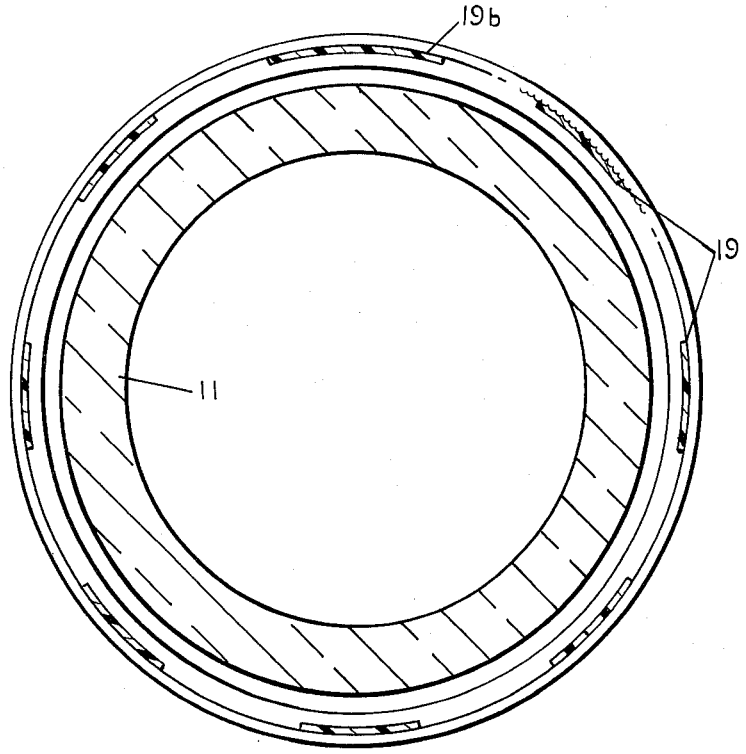
FIG. 9 is a fragmentary sectional view similar to FIG. 4 of a modified form of package.

In the modified form of the invention shown in FIG. 9, the closure is substantially identical except that the greater cross sectional area of one of the bridge portions 19*b* is achieved by the bridge portion 19*b* having a greater circumferential length rather than a greater radial thickness, as in the previously described form of the invention.

Figure 10:
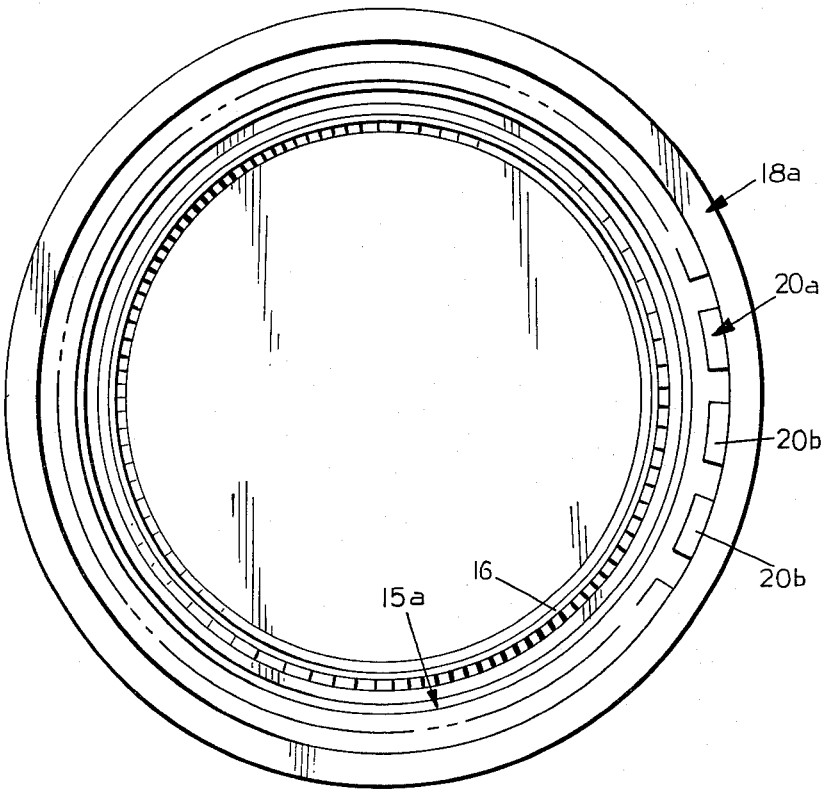
FIG. 10 is a bottom plan view of a modified closure.

In the modified form of the closure shown in FIG. 10, the pilfer ring 18*a* has a rib 20*a* comprising a plurality of circumferential bead segments 20*b* in an annular array. This enhances the flexibility of the ring 18*a* so that it can more readily snap over the annular bead 21 on the container 10.

It can thus be seen that there has been provided a closure which provides an effective indication of the fact that the closure has been removed or attempted to be removed which is simply made, easily applied, and retains the pilfer ring thereon after removal.

We claim:

1. A tamperproof package comprising a container having a neck with external threads formed thereon, a plastic closure comprising a top panel and an integral depending annular skirt, said skirt having integral internal threads formed thereon complementary to the threads on the neck of the container, said container having an annular bead positioned axially below the threads, said skirt having a ring at the lower end thereof connected to the upper portion of the skirt by a plurality of circumferentially spaced integral bridge portions located below the threads when the closure is on the container, said ring having a radially inwardly extending annular rib engaging beneath the locking bead of the container when the closure is on the container, the thickness of the ring being such that the ring will flex to an oval configuration, one of said bridge portions having a greater cross section than the remainder of said bridge portions such that when the closure is applied to the container, the rib on the pilfer ring snaps over and engages below the annular bead on the container, and when the closure is rotated to remove the closure from the container, the bridge portions are broken except for the bridge portion having the greater cross section, the ring will flex to an oval configuration as the closure is being removed so that the ring will pass over the annular bead of the container into the space between the threads of the container and the bead such that the pilfer ring remains connected to the closure.

2. The package set forth in claim 1 wherein each of said bridge portions has a greater circumferential length than radial thickness.

3. The package set forth in claims 1 or 2 wherein said bridge portion of greater cross section has a greater radial thickness than the remainder of the bridge portions.

4. The package set forth in claim 1 wherein each of said bridge portions are within the confines of the skirt and ring.

5. The package set forth in claim 1 wherein said annular bead on said ring comprises a single continuous bead.

6. The package set forth in claim 1 wherein said annular bead on said ring comprises a plurality bead segments in an annular array.

7. A tamperproof closure for a container having a neck with external threads formed thereon and having an annular bead positioned axially below the threads, said closure comprising a plastic body including a top panel and an integral depending annular skirt, said skirt having integral internal threads formed thereon adapted to engage the threads on the neck of a container, said skirt having a ring at the lower end thereof connected to the upper portion of the skirt by a plurality of circumferentially spaced integral bridge portions such that the bridge portions are located below the threads when the closure is on the container, said ring portion having a radially inwardly extending annular rib engaging beneath the locking bead of the container when the closure is on the container, one of said bridge portions having a greater cross section than the remainder of said bridge portions such that when the closure is applied to a container, the rib on the pilfer ring snaps over and engages below the annular bead on the container, and when the closure is rotated to remove the closure from the container, the bridge portions are broken except for the bridge portion having the greater cross section, the ring will flex to an oval configuration as the closure is being removed so that the ring will pass over the annular bead of the container into the space between the threads of the container and the bead such that the pilfer ring remains connected to the closure.

8. The closure set forth in claim 7 wherein each of said bridge portions has a greater circumferential length than radial thickness.

9. The closure set forth in claims 7 or 8 wherein said portion of greater cross section has a greater radial thickness than the remainder of the bridge portions.

10. The closure set forth in claim 8 wherein each of said bridge portions are within the confines of the skirt and ring.

11. The closure set forth in claim 7 wherein said annular bead on said ring comprises a single continuous bead.

12. The closure set forth in claim 7 wherein said annular bead on said ring comprises a plurality bead segments in an annular array.

* * * * *